United States Patent [19]

Usui

[11] 4,186,796

[45] Feb. 5, 1980

[54] HEAT PIPE ELEMENT

[75] Inventor: Masayoshi Usui, Numazu, Japan

[73] Assignee: USUI International Industry, Ltd., Shizuoka, Japan

[21] Appl. No.: 903,593

[22] Filed: May 8, 1978

[30] Foreign Application Priority Data

May 17, 1977 [JP] Japan ..... 52-56030
Sep. 9, 1977 [JP] Japan ..... 52-120662[U]

[51] Int. Cl.[2] ..... F28D 15/00

[52] U.S. Cl. ..... 165/105; 138/40; 138/44

[58] Field of Search ..... 165/105; 138/40, 44

[56] References Cited

U.S. PATENT DOCUMENTS

| | | | |
|---|---|---|---|
| 2,876,800 | 3/1959 | Kalff | 138/40 |
| 3,283,787 | 11/1966 | Davis | 138/44 X |
| 3,964,902 | 6/1976 | Fletcher | 165/105 X |
| 4,108,239 | 8/1978 | Fries | 165/105 |

*Primary Examiner*—Albert W. Davis, Jr.
*Attorney, Agent, or Firm*—L. Lawton Rogers, III

[57] ABSTRACT

A heat pipe element comprising an outer pipe member and an inner tubular member incorporated in the inner circumference of the outer pipe member with a capillary space defined between the two members, which inner tubular member is formed by winding in a spiral shape from a web of sheet material with a narrow continuous space between the adjacent surfaces of thus-shaped inner member so that a capillary action may occur in the narrow space. A multiplicity of fine recesses extending longitudinally of the inner and/or outer members may be formed in the inner and/or outer circumference of the inner member and/or in the inner circumference of the outer member.

10 Claims, 9 Drawing Figures

HEAT PIPE ELEMENT

BACKGROUND OF THE INVENTION

1. Field of the Invention

The present invention relates generally to a pipe element for use in a heat exchanger, or more particularly to an element to be incorporated in a so-called heat pipe for use in a heat exchanger.

The heat-pipe structure used in a heat exchanger, is today attracting attention as an efficient means of heat exchanging. It is simple in construction and is particularly effective in recovering waste heat in various industrial fields. The common structure of the prior art heat pipe is such that there is provided a capillary element or a so-called wick element with a working fluid sealed therewithin, and this wick element is encased in a container which is kept in a vacuum.

2. Description of the Prior Art

A typical example of structures for such capillary elements or wick elements for a sealed container of tubular shape which serves as a heat pipe for use in a heat exchanger, is one in which a layer or layers of sintered metal is provided around the inner circumference of the tubular container, or one in which a screen or porous material is lined in the inner circumference of the container. There is also a structure in which a screen structure is provided over the inner circumference formed with a plurality grooves.

These conventional structures, however, accompany some unavoidable drawbacks. A substantial flow resistance can, for instance, be caused on the heat exchanging medium due to the use of the screen and/or sintered metal structure within the outer pipe. There is also a possibility of the wick or the capillary element being dogged up with impurities passing through the capillary spaces. Also, as disclosed in the Japanese Patent Laid-Open Applications Nos. 35151/1976 and 82445/1976, there are undulations or corrugations formed in the inner circumference of such pipe structure or porous element incorporated in the narrow gap defined with the inner circumferential surface of the pipe structure.

These conventional structures naturally require additional labor, and moreover, the relatively weak capillary effect, makes it difficult to expect fully reliable wick or capillary functions. Furthermore, the formation of vacuum within the tubular container is extremely difficult.

An improvement of this conventional heat pipe structure by using the invented method would solve all the problems mentioned above. This invention is primarily aimed at improving the conventional heat pipe structures.

SUMMARY OF THE INVENTION

It is, therefore, the primary object of the present invention to provide an improved and useful heat pipe structure which can effectively overcome the drawbacks of the prior art arrangement as mentioned above.

Another object of the present invention is to provide an improved and unique heat pipe structure featuring excellent capillary functions which assures efficient vacuum formation as well as assembly procedures.

Still another object of the present invention is to provide an improved and unique heat pipe structure simple in construction and easy to produce, in which wick element installation and vacuum formation, would be easy.

According to the present invention, there is provided an improved and useful heat pipe structure which comprises outer elongated pipe means and inner elongated tubular means adapted to be snugly inserted into the inner circumference of the outer pipe means in a closely overlapped manner with a continuous narrow space therewith, the inner tubular means being formed in a spiral shape in such a manner that there is provided a continuous narrow space between the adjacent surfaces of the inner tubular means.

Further objects and advantageous features of the present invention will become more apparant when read the following detailed description by way of a preferred embodiment thereof in conjunction with the accompanying drawing, in which like parts are designated with like reference numerals.

DETAILED DESCRIPTION OF THE PREFERRED EMBODIMENT

A description will now be given on the present invention by way of preferred embodiments thereof in conjunction with the accompanying drawing.

Figure 1:
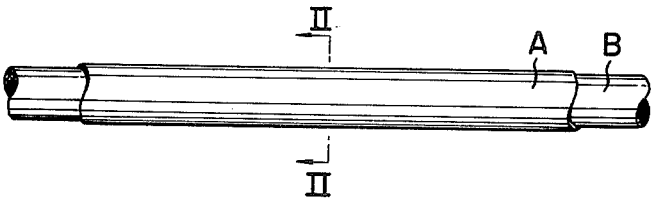
FIG. 1 is a fragmentary elevational view showing the typical construction of a heat pipe according to the present invention.
Figure 2:
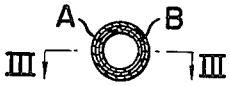
FIG. 2 is a transversal cross-sectional view taken along the line II—II in FIG. 1.

In reference to the accompanying drawing, particularly to FIGS. 1 and 2, there is generally shown, in cross-sectional view, a first embodiment of this invention, in which the heat pipe structure comprises an outer pipe member A and an inner pipe member B, the inner pipe member B being sleeved in the inner circumference of the outer pipe member A, and extending longitudinally therealong, with a narrow capillary space 2 defined with the adjacent inner circumferential surface of the outer member A. Also, as seen best in FIG. 4, the inner pipe member B is formed in such a manner that an elongated planar element 3 is formed by winding in a spiral manner into a tubular shape in a face-to-face overlapped relation so as the face an adjacent wound surface thereof, and there is formed a narrow capillary space 2' between the adjacent surfaces of the planar element 3.

Figure 3:
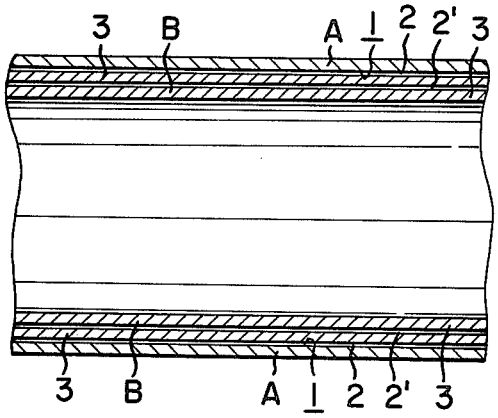
FIG. 3 is an enlarged longitudinal cross-sectional view taken along the line III–IIII in FIG. 2.
Figure 4:
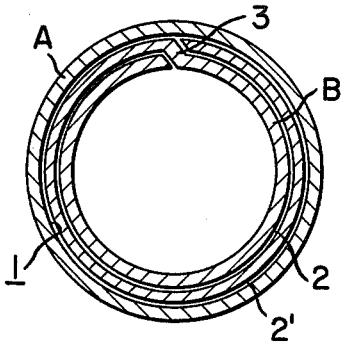
FIG. 4 is a similar, yet enlarged, view to FIG. 2; showing a first embodiment of an inner tubular member according to this invention.

In this particular embodiment, the planar element 3 was wound to the double-layered from as typically shown in FIGS. 3 and 4, so that its opposite longitudinal edges may next in a flushed relation with each other.

Figure 5A:
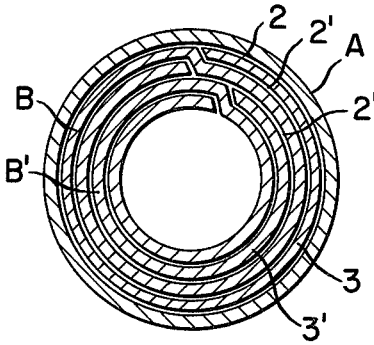
FIG. 5A is a view similar to FIG. 4 showing a further embodiment of the inner tubular member of this invention.
Figure 5:
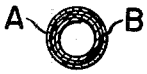
FIG. 5 is a view similar to FIG. 4 showing another embodiment of the inner tubular member of this invention.

As a second embodiment of the winding shape of the planar element 3, there is shown another manner of winding in FIG. 5, in which the planar element 3 is wound in a plane winding state so that the opposite longitudinal edges thereof may extend apart from each other and may be left stepwise. Of course, there is formed a narrow capillary space 2 between adjacent surfaces of thus-formed planar element 3.

As a third embodiment of the formation of the capillary or wick element, as shown in typically in FIG. 5A, the wick element may be formed by inserting a plurality of member units B, B', etc. having different diametral dimensions in the inner circumference of the outer pipe memeber A so that the plurality of member units may be overlapped one upon another, with a narrow capillary space 2, 2', 2'', etc. defined between each adjacent surfaces of thus-overlapped member units B, B', etc.

According to such arrangement of an element or elements to be incorporated in a heat pipe assembly, by way of preferred embodiments of this invention, there are formed a continuous gap 2, 2', etc. having an effective capillary function between each of adjacent surfaces of thus-formed inner pipe member or members. By virtue of such advantageous construction of a heat pipe assembly, when the heat pipe assembly having such arrangement is applied as a tubular container for use in a heat exchanging, a vacuum formation can be performed with an extraordinary efficiency, thus enabling the formation of a substantially high vacuum in the tubular container with ease. In addition, as such arrangement features a relatively small flow resistance for a working fluid passing through an elongated and continuous capillary gap or gaps in comparison with the conventional arrangement, a working fluid can pass through such gaps with an efficient capillary action and without interruption, thus resulting in an extraordinary efficiency of wick or capillary function.

Furthermore, by virtue of such a relatively simple construction of the heat pipe assembly according to this invention, that is, a heat pipe container can be assembled by simply inserting an inner pipe member or members B formed in a spiral shape into the inner circumference of the outer pipe member A in a closely lined fashion, an assembly work becomes substantially easy and simple, thus resulting in a high efficiency in assembling.

Figure 6:
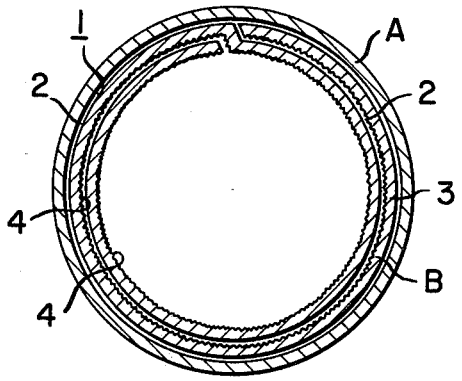
FIGS. 6 through 8 are similar views, in transversal cross-section, showing further embodiment of the invention, respectively.
Figure 7:
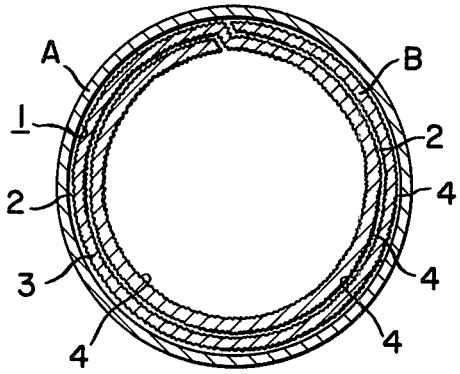
Figure 8:
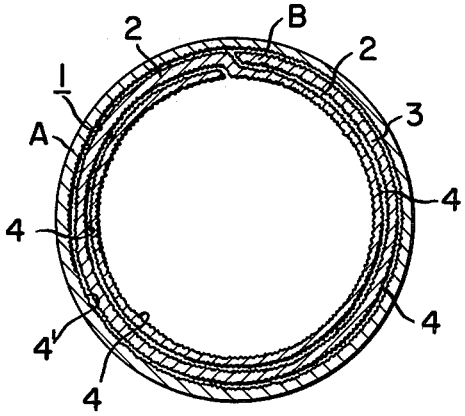

Now, referring to FIGS. 6 through 8, there are shown further modifications of this invention specifically designed for attaining a further improvement in the wick or capillary action efficiency of the heat pipe assembly of the arrange according to the precedent embodiments stated hereinbefore. That is, among such modified arrangement, there are a multiplicity of fine recesses or corrugations extending longitudinally in the circumferential surface or surfaces of the inner pipe member or members B which are formed in a spiral shape with a continuous narrow capillary space between the adjacent surfaces of the inner pipe member or members. These fine recesses or corrugations naturally increase the area where a capillary action takes place, thus contriuting to a further improvement in a fluid flow efficiency induced with a capillary phenomenon, thereby to result in a substantial improvement of the heat pipe assembly working efficiency including such advantageous constructional feature.

More specifically, FIG. 6 shows a first modification wherein there are formed a multiplicity of fine corrugations 4 in the inner continuous circumferential surface of the inner pipe member B. In a second modification typically shown in FIG. 7, there are provided similar fine corrugations 4 in the both inner and outer surfaces of the inner pipe member B. The provision of such fine corrugations 4 are specifically designed to substantially improve the wick function of the fine capillary gap 2 defined between the adjacent surfaces of the spiral inner pipe member B. It is apparent that the surface area formed with such fine corrugations will decide the extent of contribution to such improvement of the capillary function. Therefore, the modification shown in FIG. 7 will naturally bring a further grester improvement in the efficiency of capillary action than the arrangement shown in FIG. 6.

The formation of a multiplicity of such fine longitudinal corrugations 4 in the surface or surfaces of the inner pipe member B is carried out prior to the winding procedure of the member B to a spiral shape, thereafter it is inserted into the inner circumference of the outer pipe member A in the same manner as in the precedent embodiments shown in FIGS. 3 through 5A.

Now, with respect to the modification shown in FIG. 8, there is provided an outer pipe member A formed with a multiplicity of fine longitudinal corrugations 4' in the inner circumference and longitudinally of itself. Into thus-prepared outer pipe member A, there is installed the inner pipe member B having the fine longitudinal corrugations 4 in the both inner and outer circumferences thereof in position. In such arrangement, it is of course possible to insert the inner pipe member B formed with the fine longitudinal corrugations 4 in its inner circumference only into the outer pipe member A having such fine corrugations as stated above.

The transversal cross-sectional shape of the fine recesses or corrugations 4 may be of either a generally V-letter shape or a generally U-letter shape, or furthermore, any other shapes will do whichever has a form of recess that contributes to an improvement in the capillary action of the pipe members incorporated therein.

What is claimed is:

1. In a heat pipe element having an outer pipe member and an inner wick or capillary member incorporated in the inner circumference of said outer pipe member, the improvement which comprises outer elongated pipe means and inner elongated tubular means adapted to be snugly inserted into the inner circumference of said outer pipe means in a closely overlapped manner with a continuous narrow space therewith, said inner tubular means being formed in a spiral shape in such a manner that there is provided a continuous narrow space between the adjacent surfaces of said inner tubular means, said inner tubular means being provided with a multiplicity of fine recesses or corrugations extending longitudinally of said inner means in either of circumferential surfaces thereof.

2. The improvement as claimed in claim 1 wherein said inner tubular means are formed in such a spiral shape that each of opposite edges of said tubular means may extend in a flushed relation along the length thereof in both outer and inner circumferences thereof.

3. The improvement as claimed in claim 1 wherein said inner tubular means are formed in such a spiral shape that each of opposite edges of said tubular means may be left in a projected relation in both outer and inner circumferences thereof.

4. The improvement as claimed in claim 1 wherein said inner tubular means consists of a plurality of member units with gradually decreasing diameters, which are snugly inserted within the throughfore of said outer means in the one-into-another inserted fashion and each of said member units having a narrow space formed between the adjacent surfaces of said member units.

5. The improvement as claimed in claim 1 wherein said multiplicity of fine recesses or corrugations are formed in both inner and outer circumferential surfaces of said inner tubular means.

6. In a heat pipe element having an outer pipe member and an inner wick or capillary member incorporated in the inner circumference of said outer pipe member, the improvement which comprises outer elongated pipe means formed with a multiplicity of fine recesses or corrugations extending longitudinally thereof and in the inner circumference thereof, and inner tubular means adapted to be snugly inserted into the inner circumference of said outer pipe means in a closely overlapped manner with a continuous fine gap therewith, said inner tubular means being formed in a spiral shape in such a manner that there is provided a continuous narrow space between the adjacent surfaces of said inner tubular means, said inner tubular means being further formed with a multiplicity of fine recesses or corrugations extending longitudinally thereof and in at least one of circumferential surfaces thereof.

7. The improvement as claimed in claim 6 wherein said inner tubular means are formed with said multiplicity of fine recesses or corrugations in the inner circumference thereof.

8. The improvement as claimed in claim 6 wherein said inner tubular means are formed with said multiplicity of fine recesses or corrugations in the both inner and outer circumferences thereof.

9. The improvement as claimed in claim 6 wherein said multiplicity of fine recesses may be of a generally V-letter shape in transversal cross-section.

10. The improvement as claimed in claim 6 wherein said multiplicity of fine recesses may be of a generally U-letter shape in transversal cross-section.

* * * * *